US007922414B2

(12) United States Patent
Palmquist

(10) Patent No.: US 7,922,414 B2
(45) Date of Patent: Apr. 12, 2011

(54) M-LINK

(75) Inventor: Bjorn Palmquist, Gothenburg (SE)

(73) Assignee: Moorlink AB, Gothenburg (SE)

( * ) Notice: Subject to any disclaimer, the term of this patent is extended or adjusted under 35 U.S.C. 154(b) by 0 days.

(21) Appl. No.: 12/187,588

(22) Filed: Aug. 7, 2008

(65) Prior Publication Data

US 2009/0026779 A1 Jan. 29, 2009

Related U.S. Application Data

(63) Continuation of application No. 11/696,339, filed on Apr. 4, 2007, now abandoned.

(51) Int. Cl.
*F16G 11/00* (2006.01)

(52) U.S. Cl. ..... 403/209; 403/210

(58) Field of Classification Search ..... 403/209, 403/210, 212, 215, 216

See application file for complete search history.

(56) References Cited

U.S. PATENT DOCUMENTS

| | | | | |
|---|---|---|---|---|
| 4,341,291 | A | 7/1982 | Flory et al. | |
| 5,212,939 | A | 5/1993 | Pratt, Jr. | |
| 6,490,853 | B1 | 12/2002 | Winklhofer et al. | |
| 2006/0150883 | A1 * | 7/2006 | Gordon et al. | 114/230.23 |

FOREIGN PATENT DOCUMENTS

| | | |
|---|---|---|
| GB | 122820 | 7/1919 |
| GB | 2117084 | 10/1983 |

* cited by examiner

*Primary Examiner* — Victor MacArthur
(74) *Attorney, Agent, or Firm* — Gauthier & Connors LLP

(57) ABSTRACT

The present invention relates to a link for joining mooring lines having an eye at their joining end, characterized in that the link comprises two side plates joined by two hollow, cylindrical or non-cylindrical shafts, which shafts have a diameter which allows the bending of a polymer line around it without causing breakage to the strands of the polymer line.

1 Claim, 2 Drawing Sheets

M-LINK

PRIORITY INFORMATION

The present application is a continuation application of U.S patent application Ser. No. 11/696,339, filed on Apr. 4, 2007.

TECHNICAL FIELD

The present invention relates to a link for connecting long a heavy duty anchoring means or mooring line/s to each other.

BACKGROUND OF THE INVENTION

At deep sea oil drilling and oil recovery the platforms used for these purposes have to be anchored. This is done by means of mooring lines being of substantial length. Normally these lines are too long to be produced and/or handled in one length over all, thus have to be joined together during the installation off shore. Today, many mooring lines are manufactured of synthetic material in order to be as light as possible as the mooring line may take the length of thousands of meters when it comes to deep sea mooring, such as in the Gulf of Mexico.

As the lines cannot be manufactured in the lengths requested different methods for joining line segments together has been proposed, whereby one method includes a so called H-link, where lines comprising an eye prepared around a thimble or other device for enlarging the diameter are connected to solid bars attached to connecting plates, one on each side of the line eyes. The drawbacks with these known joints are that the lines, having a fairly large cross diameter, are subject to breakage in the eye part as there are lot of tensions built in creating the relatively small eye around the thimble, as well as the eyes have to be preprepared, as the thimble calls for additional tools.

SUMMARY OF THE PRESENT INVENTION

The present invention aims to solve the problem of breakage in particular by providing for a larger diameter to be used in the eye.

DETAILED DESCRIPTION OF THE INVENTION

In particular the present invention relates to an M-link for joining mooring lines having an eye at their joining end, characterized in that the link comprises two side plates joined by two hollow, cylindrical or non cylindrical shafts, which have a diameter which allows the bending of a polymer line around it without causing breakage to the strands of the polymer line.

In a preferred embodiment of the invention, the hollow cylindrical or non-cylindrical shafts are opened to the outer side of the side plates.

The invention will now be described more in detail with reference to the accompanying drawing, wherein

Figure 1:
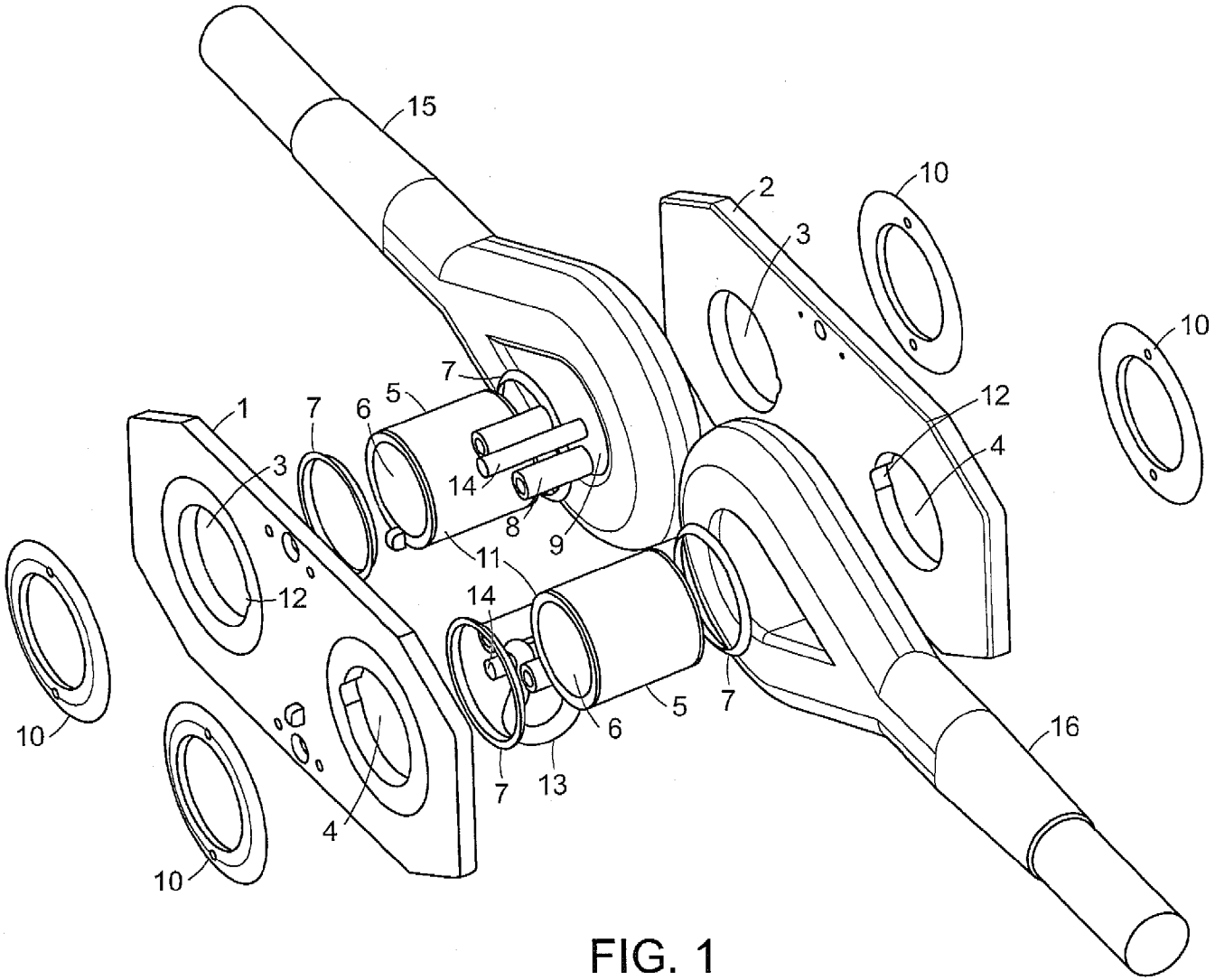
FIG. 1 shows an exploded diagram as perspective view of a link according to the present invention.
Figure 2:
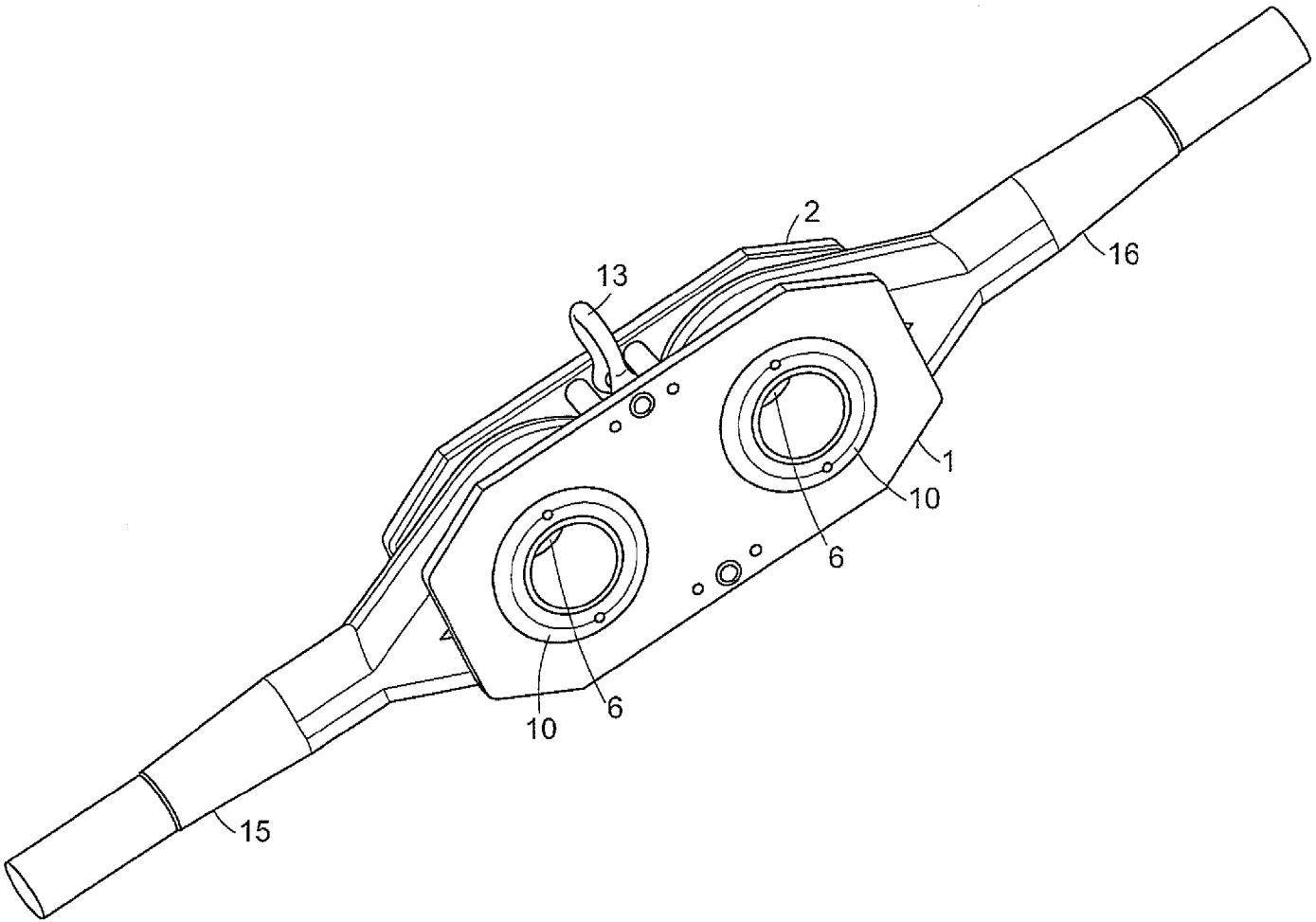
FIG. 2 shows the assembled link of FIG. 1.

1 and 2 denote side plates each being provided with two major through going holes 3 and 4. The holes 3 and 4 are interconnected with two hollow shafts 5, which shafts 5 have a geometry corresponding to the geometry of the holes 3 and 4. The hollow shafts 5 are made cylindrical or non cylindrical, i.e., they are provided with corresponding through going openings 6. The shafts 5 are provided with rings 7 at each end to fit in with the holes 3 and 4 into which the shafts 5 are introduced. The side plates 1 and 2 are joined together with at least two bolts 9 and distance pipes 8. On the outer sides of the side plates 1 and 2 there are provided locking rings 10 to lock any sidewise, or movement of the cylindrical or non-cylindrical shafts 5 along their longitudinal axes.

By using cylindrical or non cylindrical shafts 5 the diameter of these can be radically larger yet maintaining the same weight compared to a solid shaft thus the connection can be done without a need for the additional thimble or other device for enlarging the diameter of the connecting shaft. This further means that breakage of the polymer lines will not be induced to the extent that appears if the eye would have a smaller diameter. It should be recognized that the hollow shaft may take a diameter which is at least twice that of a solid one.

In a suitable embodiment the hollow shafts 5 are provided with peripheral, longitudinally extending projections 11 fitting inside corresponding grooves 12 arranged in the walls of the holes 3 and 4. This makes the shafts 5 non-rotatable.

A shackle 13 can be attached to the link via a shackle pin 14, which is attached between the side plates 1 and 2. The shackle 13 is used to handle the link, such as lifting the link over board a tug where joining of two lines has been made.

However, the shackle 13 may be deleted, as the cylindrical or non-cylindrical, hollow shafts 5 will provide the recesses needed for entering lifting means into.

The linking together of mooring lines can be made in two ways: either by having the mooring lines 15 and 16, respectively preprepared with eyes, or preparing the eyes at the site. When preparing at site the line can be introduced over the shafts 5 between the side plates 1 and 2 and is then joined to itself by means of a hardenable polymer such as polyurethane.

An M-link made to manage the forces that may appear from the mooring lines, line weight and drawing forces, is quite large and heavy (up to 4 tons). By using a cylindrical or non cylindrical shaft, total weight to be handled during installation can be reduced since the need of a thimble or other enlarging devices is omitted.

The new link design thus provides a number of advantages over the prior art in that it eliminates the need for handling/installation of shackles; eliminates the need for spools/thimbles or other devices for enlarging the diameter of the connecting shaft. due to the large diameter of the hollow shafts; provides lower stresses in the shafts and side plates due to the large diameter, which allows for a lower grade steel material saving costs and increases availability of material including shorter lead times; provides for easier handling and fitting of the shaft during installation, which saves installation time, which in turn means lower costs; provides for simple offloading possibilities as the hollow shafts can be used for lifting and handling; and as there is no need for a shackle the link can be placed vertically directly on deck a boat.

The invention claimed is:

1. A mooring link connector comprising two side plates, each provided with two through-going holes and joined to each other by at least two bolts and distance pipes, wherein the plates are further interconnected by two hollow, cylindrical or non cylindrical shafts, arranged between the through-going holes on said plates, said hollow, cylindrical or non-cylindrical shafts being prevented from any movement along their longitudinal axis by locking rings fitted onto each of the through-going holes on the outside of the side plates and being provided with peripheral, longitudinally extending projections arranged to fit inside grooves arranged in the walls of the through-going holes of the side plates making the shafts non-rotatable.

* * * * *